US010890401B2

(12) United States Patent
Sautmann et al.

(10) Patent No.: US 10,890,401 B2
(45) Date of Patent: Jan. 12, 2021

(54) SOUND SUPPRESSOR

(71) Applicants: David Sautmann, Bremerhaven (DE); Niklas Becker, Bremen (DE); Benjamin Thielemeier, Port St. Mary (IM)

(72) Inventors: David Sautmann, Bremerhaven (DE); Niklas Becker, Bremen (DE); Benjamin Thielemeier, Port St. Mary (IM)

( * ) Notice: Subject to any disclaimer, the term of this patent is extended or adjusted under 35 U.S.C. 154(b) by 0 days.

(21) Appl. No.: 16/223,280

(22) Filed: Dec. 18, 2018

(65) Prior Publication Data

US 2019/0186859 A1 Jun. 20, 2019

(30) Foreign Application Priority Data

Dec. 19, 2017 (DE) ..... 10 2017 011 751

(51) Int. Cl.
*F41A 21/30* (2006.01)
*F41A 21/06* (2006.01)

(52) U.S. Cl.
CPC ..... *F41A 21/30* (2013.01); *F41A 21/06* (2013.01)

(58) Field of Classification Search
CPC ..... F41A 21/30; F41A 21/32; F41A 21/40–42
See application file for complete search history.

(56) References Cited

U.S. PATENT DOCUMENTS

| | | | | |
|---|---|---|---|---|
| 4,713,904 | A * | 12/1987 | Anderson | F41A 21/40 42/79 |
| 6,789,343 | B1 * | 9/2004 | Dietrich | F41A 21/40 42/79 |
| 9,097,482 | B1 * | 8/2015 | Holden | F41A 21/30 |
| 9,835,400 | B2 * | 12/2017 | Barrett | F41A 21/325 |
| 10,094,633 | B2 * | 10/2018 | Bertschinger | F41A 21/30 |
| 10,094,663 | B2 * | 10/2018 | Kesaniemi | G01C 17/28 |
| 2019/0113296 | A1 * | 4/2019 | McRorey | F41A 21/325 |

FOREIGN PATENT DOCUMENTS

| | | | | |
|---|---|---|---|---|
| AT | 124994 | B | 10/1931 | |
| DE | 69506416 | T2 | 6/1999 | |
| EP | 0772758 | B1 * | 12/1998 | G10K 11/16 |
| EP | 0772758 | B1 | 12/1998 | |
| EP | 3056852 | A1 | 8/2016 | |
| WO | 2011035111 | A1 | 3/2011 | |
| WO | 2014149142 | A2 | 9/2014 | |

OTHER PUBLICATIONS

Deutsches Patent—Und Markenamt (German Patent and Trademark Office), Recherchebericht (Search in a related application), Nov. 14, 2018.

* cited by examiner

*Primary Examiner* — Joshua T Semick
(74) *Attorney, Agent, or Firm* — Laurence P. Colton; Smith Tempel Blaha LLC

(57) ABSTRACT

A sound suppressor for a firearm having one or more barrels, with at least one projectile pathway and with one or more choke-like connectors for insertion into at least one barrel of the firearm.

25 Claims, 14 Drawing Sheets

28
73
72
B
B
65
63
64

28
73
B-B
65
75
27
74

68
70
72
63
64
73
72
73
76
74
73

28
70
72
73
76
74
77
71
71
75

SOUND SUPPRESSOR

CROSS REFERENCE TO RELATED APPLICATIONS

This patent application claims priority on and the benefit of German Patent Application No. 10 2017 011 751.9 having a filing date of 19 Dec. 2017.

BACKGROUND OF THE INVENTION

Technical Field

The invention relates to a sound suppressor for a firearm having one, two or more barrels with at least one projectile pathway. The sound suppressor is in particular intended for a shotgun and should preferably be operable in connection with shotgun slugs.

Prior Art

Known from EP 3 056 852 A1 is a sound suppressor for an over-and-under shotgun. A plurality of baffles are provided in a housing and arranged in succession in the direction of fire. Each baffle has two separate rows of apertures for a projectile.

Shown in DE 695 06 416 T (corresponding to EP 0 772 758 B1) is a sound suppressor for double-barrel guns.

WO 2014/149142 A2 discloses a silencer having radially directed bore openings in baffles. At the same time, the baffles are provided with outer threads which assume the function of gas channels.

Shown in AT 124994 is a sound suppressor for a machine gun. The front piece and back piece are connected to each other by means of long connecting screws.

WO 2011/035111 A1 shows a sound suppressor having a housing with an octagonal cross section.

BRIEF SUMMARY OF THE INVENTION

The object of the present invention is to provide a sound suppressor with improved performance. Preferably it should be possible to connect the sound suppressor with the barrel of a firearm, especially a shotgun barrel, in a particularly secure manner. Likewise, it should be preferably possible to expand the sound suppressor in a simple a manner as possible. The various components of the sound suppressor should in particular be easily and securely connectable to one another. Finally, it should be possible to easily connect the sound suppressor with auxiliary devices for which no mounts are provided on the firearm.

To achieve this object, the sound suppressor is a sound suppressor for a firearm having one or more barrels, with at least one projectile pathway and one or more choke-type connectors for the insertion into at least one barrel of the firearm. In particular, the sound suppressor for a firearm having one or more barrels can feature one or more choke-type connectors which can be inserted in at least one barrel. Chokes are screwed into the barrel, thereby narrowing the diameter of the respective muzzle in the known manner. Shotgun chokes are typically used to alter the spread of shot. Shotgun barrels can have the appropriate thread for interchangeable chokes. Here they are used for mounting the sound suppressor.

In another aspect of the present invention, a wall facing the at least one barrel may be provided with one aperture per barrel for allowing the projectile to pass through, wherein the connector exhibits an enlargement of the effective outer diameter at the end pointing in the firing direction, with the enlargement abutting against a side of the wall facing away from the barrel. The wall of the sound suppressor is situated in front of the barrel and is held on the barrel muzzle by the enlargement of the outer diameter while the connecter is inserted in the barrel.

In another aspect, the enlargement of the effective outer diameter at the end of the connector may be a circumferential collar. This provides uniform circumferential contact pressure for the wall.

In another aspect, collar and wall may have mutually corresponding and circumferential abutment surfaces, with each being inclined in the radial direction. Having the same inclination, the abutment surfaces contact one another over their full surface, thus providing a centering of the sound suppressor on the barrel and preventing the escape of gas in the region of the enlargement.

In another aspect, the connector may be threaded for attachment to the barrel, wherein the connector is provided with an outer sleeve that is axially displaceable but held on the connecter in an anti-twist manner. The thread on the connector is preferably an outer thread. The connector can be screwed into the barrel by means of the outer sleeve.

In another aspect, the connector may be provided externally with one or more axially directed depressions, wherein the outer sleeve has one or more protrusions on the inside, and wherein the protrusions conform to the position and shape of the depressions and engage there, with the result that the outer sleeve is secured against twisting on the connector. When the outer sleeve is twisted, the protrusions move the connector along with the twisting movement.

As an overview or modification of the above features, the sound suppressor for a firearm having one or more barrels can have one or more choke-like connectors for the insertion into at least one barrel of the firearm, wherein one wall of the sound suppressor facing the barrel is provided with at least one aperture for the projectile to pass through, wherein the connector has an enlargement of its effective outer diameter at the distal end as seen in the firing direction and the enlargement abuts against a side of the wall facing away from the barrel, and wherein the connector has a thread for its attachment in the barrel and the connector is provided with an outer sleeve that serves as a mounting ring that is axially displaceable on the connector but protected against twisting on it and can thereby be screwed into the barrel of the firearm in the manner of a exchangeable choke. In the process, the wall is clamped between the enlargement and the muzzle of the barrel.

In another aspect, the outer sleeve may have flat portions on its outer side for the application of a tool. The flat portions are preferably configured and arranged relative to one another in such a manner that an open-end wrench or pliers can be applied for gripping.

The subject matter of the invention also includes a sound suppressor for a firearm having one or more barrels, with two or more projectile pathways, a common expansion chamber for two or more projectile pathways, two or more apertures for the projectile to pass through and an insert for closing one of the apertures for the projectile. As a result, a sound suppressor with two projectile pathways and for two barrels can also be employed for a firearm having just one barrel. In this case, the volume of the expansion chamber intended for two barrels is used for the one barrel. The insert preferably closes an aperture for the projectile on the sound suppressor facing the barrel. The common expansion chamber for two or more projectile pathways is not necessarily divided into separate and parallel chambers for each barrel or projectile pathway. This results in a relatively large space for distributing the propellant gases discharged from one of the barrels following a fired shot. These gases may enter the region of an adjacent projectile pathway or, in the case of multi-barrel firearms, even enter the non-used barrel. The common expansion chamber is thus advantageous even without an insert.

In another aspect of the invention, the expansion chamber may be configured to define a cuboid shape. By virtue of its cuboid shape, the expansion chamber contains more usable volume for the expansion of the propellant gases than a cylindrical chamber of the same width (as measured in the horizontal and transverse directions with respect to the firing direction).

In another aspect, the common expansion chamber may be connected to at least one of the barrels. The expansion chamber is preferably connected to one or more of the barrels by means of appropriate connecting means, in particular such that the barrel and expansion chamber abut one another. The connecting means are preferably gas-tight so that propellant gases from the barrel are able to enter the expansion chamber but are not able to escape outwards into the region of the connection means.

In another aspect, separate chambers may be provided in succession in the firing direction between which the passage of gases is possible not only along apertures for the projectile but along other openings as well. By virtue of the additional openings, it is possible to achieve a more rapid distribution of the propellant gases across a plurality of chambers.

In another aspect, two or more projectile pathways each may run through the successive individual chambers in the firing direction without having to provide separate sub-chambers for each projectile pathway. This means that a single chamber comprises the projectile pathways of two (or more) barrels, with the result that, when a shot is fired, the entire volume of the chamber can be utilized as the expansion space.

In another aspect, a sound suppressor for a firearm with at least one barrel may have a plurality of elements arranged in succession in the firing direction, wherein at least two of these elements are connected to each other by rods. Preferably four rods are provided in a symmetrical arrangement. The rods are joined to the elements to be connected by welding, bonding or bolted connections.

In another aspect, the rods may be disposed on or in the outer walls of the elements. The elements arranged in succession in the firing direction are preferably provided with retainers or channels on the outer walls. The rods extend in particular within the channels.

In another aspect, the rods may connect an expansion chamber with an end plate. Here the expansion chamber and end plate are also provided with channels for accommodating the rods.

According to a further idea of the invention, a sound suppressor for a firearm with at least one barrel may have a baffle chamber comprising at least one baffle, wherein the baffle has a circumferential wall running around one or more apertures for the projectile, and wherein the wall has openings, in particular bore holes, arranged transversely to the firing direction, and is provided on its outer side with reinforcements, which in conjunction with chamber walls of the baffle chamber form gas channels running parallel in the firing direction. The openings can extend entirely or in part into the gas channels. The circumferential wall preferably defines a cuboid shape with two mutually opposite and open sides as relatively large apertures for the projectile. Inasmuch as the sound suppressor is intended for two or more barrels, the aperture in the baffle for the projectile preferably covers a greater area than the cross section of all barrels together. For closing the open sides, the baffle can comprise a front wall or rear wall having relatively small apertures for the projectile. In particular, one aperture for the projectile per barrel is thereby provided in the front wall or rear wall.

In another aspect, the gas channels may define cross sections which, due to the corresponding configuration of the reinforcements, may increase or decrease in size in the firing direction. As a result, several or all gas channels have a conical configuration with the corresponding effect exerted on the propellant gases, that is to say an either expanding or compressing effect.

In another aspect, at least two different baffles may be arranged in the baffle chamber, in particular with a baffle of a first type alternating with a baffle of a second type, if appropriate being interspaced with silencer mats or other elements.

According to the invention, the baffles in the baffle chamber may be configured and arranged such that the propellant gases are able to expand completely throughout the entire sound suppressor in the firing direction in addition to their expansion through the apertures for the projectile. The propellant gases are indeed stopped or damped by the baffles. However, a slight flow of gasses remains possible in the firing direction in order to avoid the formation of any pressure peaks, in particular along the aforementioned gas channels.

In another aspect, at least two baffles can be provided in succession in the firing direction. Sound suppression can be effectively improved by employing a plurality of baffles.

In another aspect, a sound suppressor for a firearm having at least one barrel may comprise a multi-part construction as seen in the firing direction, with a front piece for connecting to at least one barrel, a baffle chamber having one or more baffles, an end piece and with connecting devices which extend from the end piece to the front piece. The connecting devices are preferably not fixed to the baffle chamber, at least not in the axial direction. However, attaching or securing them to the baffle chamber transversely to the axial direction or on a guide on the baffle chamber is advantageous. The baffle chamber is preferably a housing for accommodating baffles that is open at two opposite ends and is in particular of cuboid shape.

Due to the modular design with front piece, baffle chamber and end piece, it is possible to vary the overall length. For this purpose, only the number of baffles must be determined and the lengths of the baffle chamber and connecting devices adjusted accordingly. Preferably, all baffles have the same length. For example, if a baffle chamber of a defined length L is used in conjunction with one baffle, then for three (or n) baffles having the same length a baffle chamber having a length of 3L (or nL) should be used. A different calculation is be made for the dimensions of the employed connecting means, since these should extend from the end cap to the front piece. The connecting means must be made to conform to the absolute change of length of the baffle chamber.

In another aspect, front piece and baffle chamber may have complementary circumferential shoulders to ensure that no relative movement transverse to the firing direction is possible. Front piece and baffle chamber are centered on one another by the corresponding shoulders.

In another aspect, the baffle chamber and end piece may have complementary circumferential shoulders to ensure that no relative movement transverse to the direction of fire possible. A centering action is also present here.

In another aspect, a sound suppressor for a firearm having at least one barrel may have at least one adapter for a rail used for the attachment of accessory parts. Known in this regard, for example is the so-called Picatinny rail, to which an optical scope or other accessories can be interchangeably attached. The rail has standardized boreholes for connecting means. The adaptor may be attached to an outer side of the sound suppressor by adhesive bonding, welding or screw connections.

In another aspect, the adapter may be formed by one or more raised portions on an outer side of the sound suppressor, wherein the raised portion has one or more boreholes for connecting the rail to the adaptor. The raised portion may be a strip of sufficient thickness, preferably with threaded holes.

In another aspect, a sound suppressor for a firearm having at least one barrel may comprise at least one baffle and at least one silencer mat, such as a sound suppressor having at least one baffle chamber which comprises at least one baffle and at least one silencer mat. Preferably the silencer mat is provided between two baffles. The silencer mat has apertures for the projectile which match the caliber of the barrels. Their overall cross section is preferably smaller than the entire open cross section of the baffle. The silencer mat is preferably made of steel mesh and can be either dry or impregnated with fluid, for example with oil, lithium grease or water.

In another aspect, the silencer mat may be provided with a three-dimensional frame, namely with an extension transverse to the firing direction and in the firing direction. The frame is preferably one comprising connecting braces or outer circumferential walls. The frame is in particular rigid and is meant to ensure the consistent outer dimensions of the silencer mat.

Inasmuch as components of the sound suppressor have an aperture for the projectile or pairs or groups of said apertures, the latter preferably assume a central arrangement. According to the invention, the apertures for the projectile can also be offset upwards in a departure from a central position. As a result, a top overhang of the device above the barrel of the firearm is decreased, thus resulting in a better line of sight.

Finally, one subject matter of the invention is also a firearm having one of the sound suppressors described above. The firearm is preferably a shotgun, over-and-under shotgun or a side-by-side shotgun having one, two or three barrels, for shotgun shells or shotgun slugs.

BRIEF DESCRIPTION OF THE DRAWINGS

Further features of the invention can be taken from the remaining description and from the claims. Advantageous embodiments are described below in more detail with reference to the drawings, wherein

DETAILED DESCRIPTION OF PREFERRED EMBODIMENTS

Figure 1:
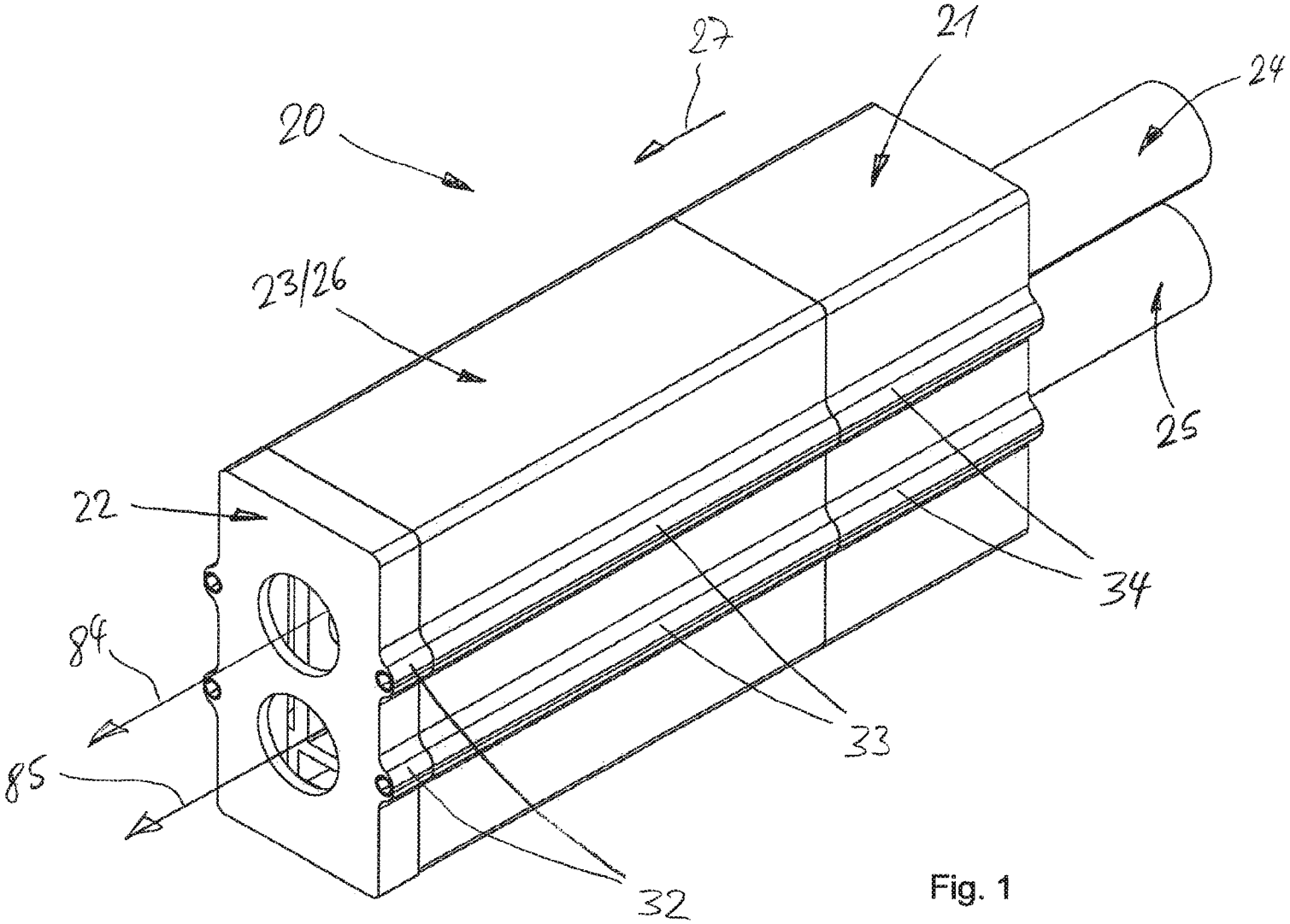
FIG. 1 shows a perspective view of a sound suppressor.
Figure 2:
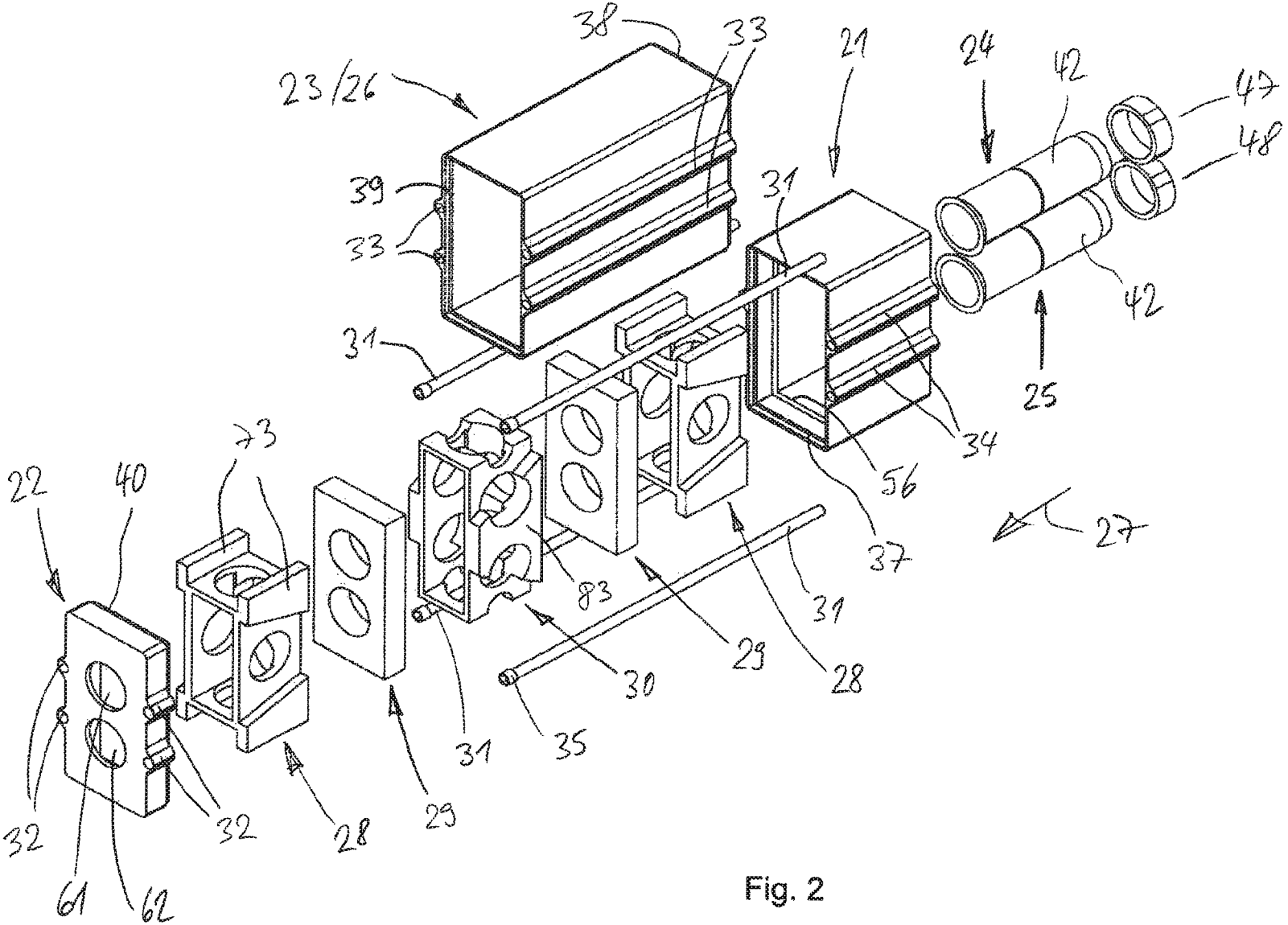
FIG. 2 shows an exploded perspective view of the sound suppressor in FIG. 1.
Figure 3:
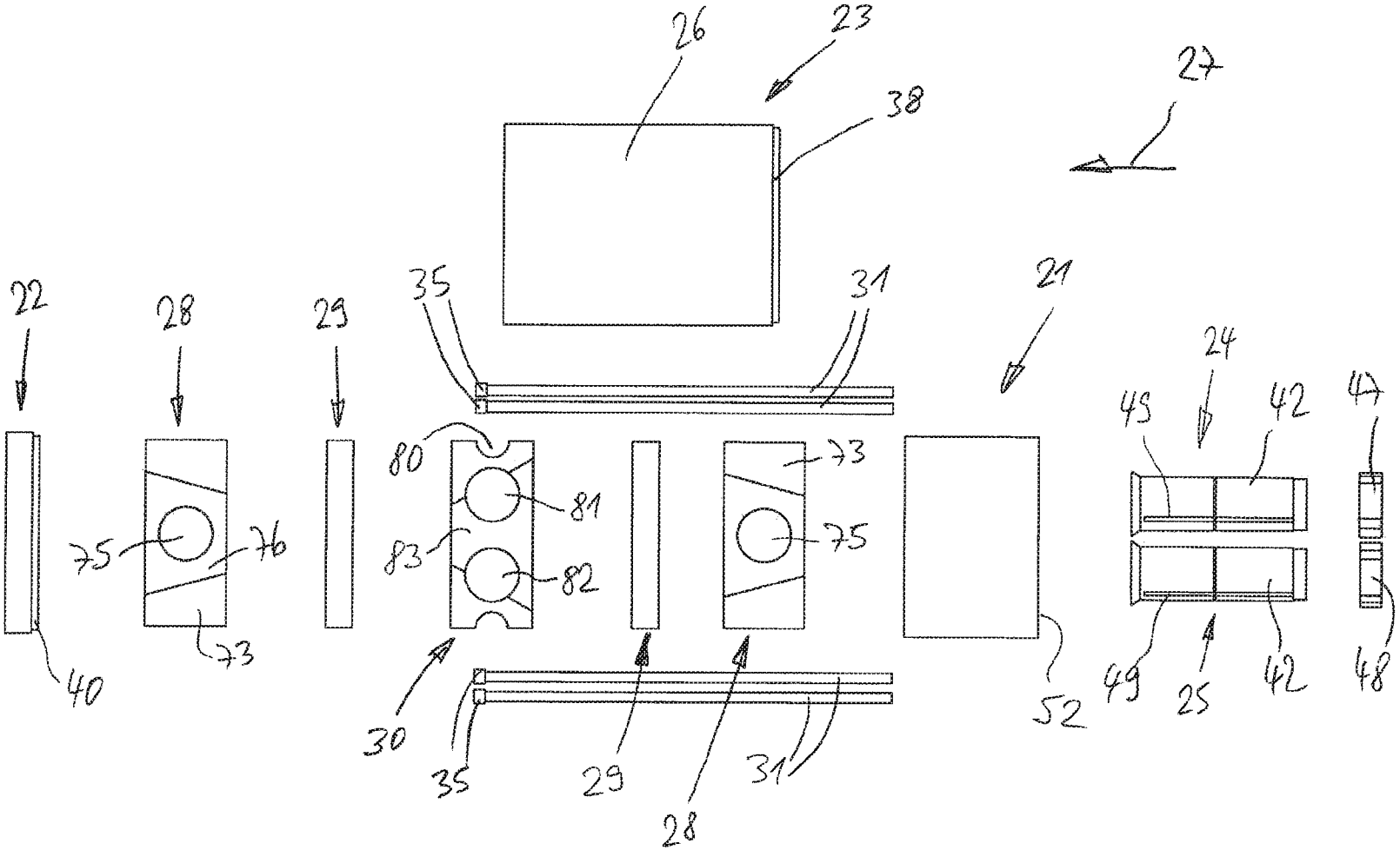
FIG. 3 shows an exploded side view of FIG. 2.
Figure 4B:
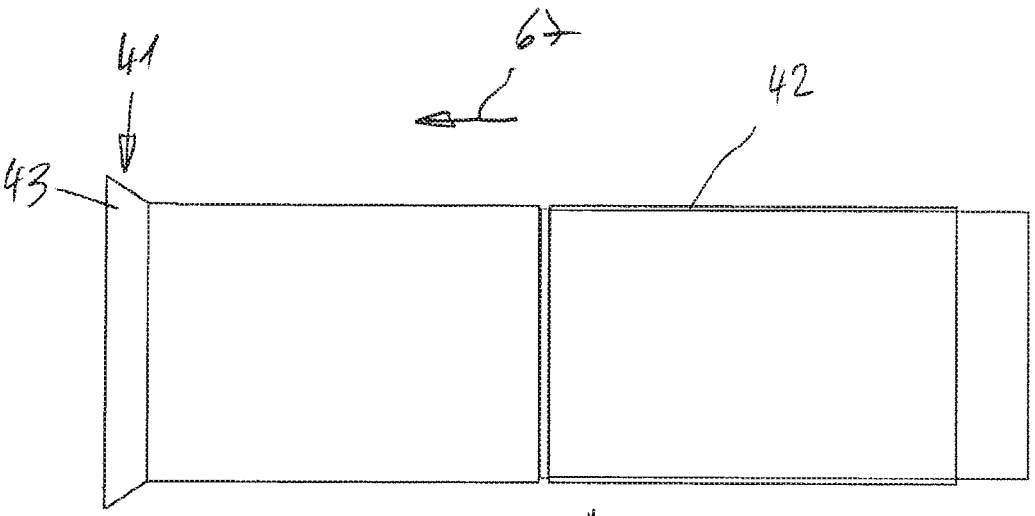
FIG. 4*b* shows a side view of the connector in FIG. 4*a*.
Figure 4C:
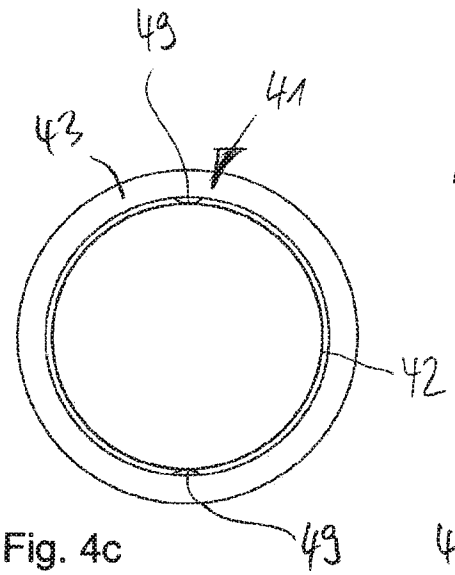
FIG. 4*c* shows an end view of the connector in FIG. 4*a*.
Figure 4A:
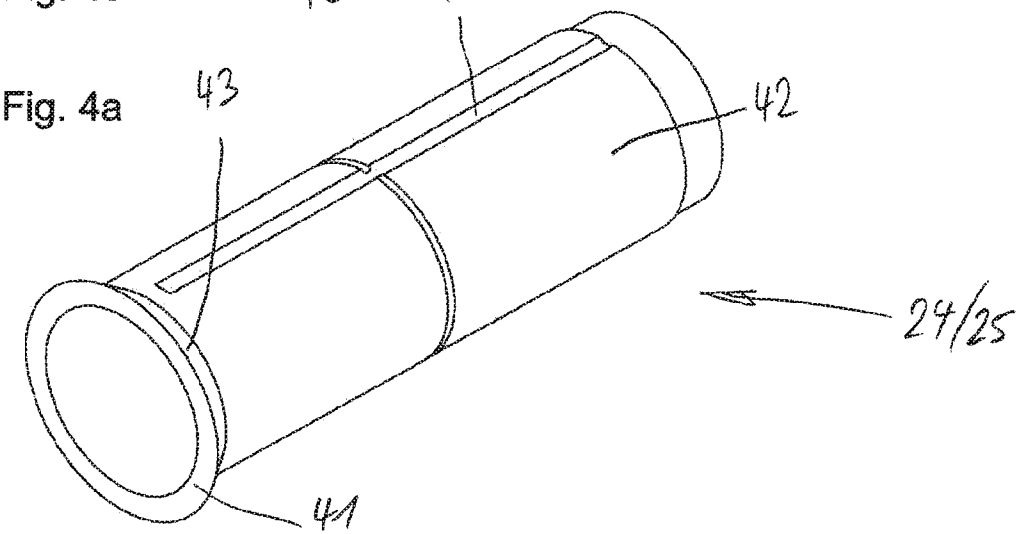
FIG. 4*a* shows a perspective view of a choke-like connector.
Figure 5B:
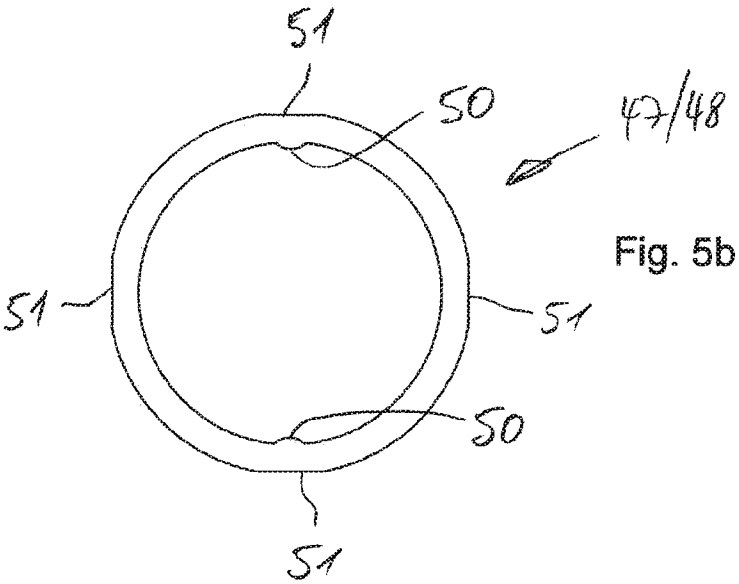
FIG. 5*b* shows an end view of the sleeve in FIG. 5*a*.
Figure 5C:
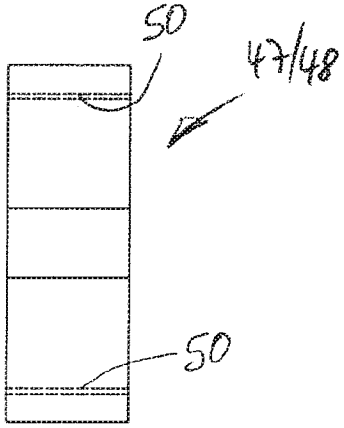
FIG. 5*c* shows a side view of the sleeve in FIG. 5*a*.
Figure 5A:
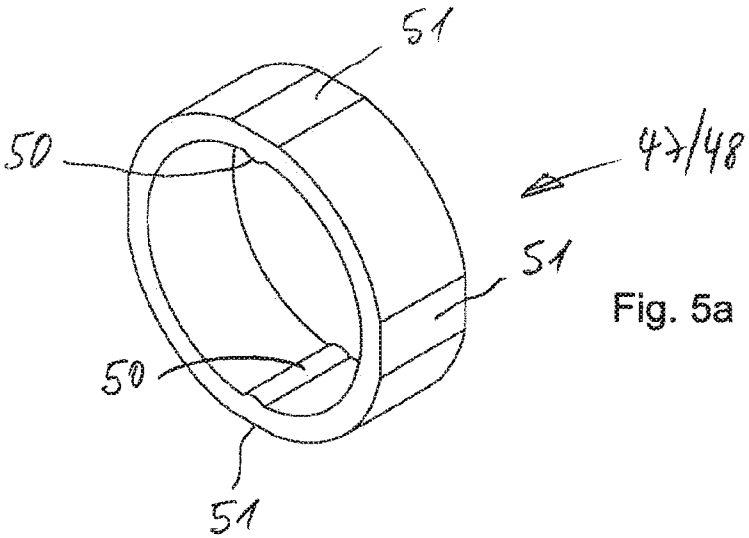
FIG. 5*a* shows a perspective view of a sleeve for the connector.

Reference is first made to FIGS. 1 to 3. Shown there is a sound suppressor 20 according to the invention with an expansion chamber 21 (here: cuboid-shaped) as the front piece, a rectangular end plate 22 as the end piece, a baffle chamber 23 between expansion chamber 21 and end plate 22, and with connectors 24, 25 for attaching the sound suppressor 20 to the two barrels of an over-and-under shotgun (not shown) or any other double-barreled firearm.

Here the baffle chamber 23 has a cuboid-shaped housing 26 which is open at its two opposite ends. Arranged in succession in the housing 26 in the direction of fire (arrow 27), with as little play as possible, is a baffle 29 of a first type, a silencer mat 29, a baffle 30 of a second type, a further silencer mat 29 and a further baffle 28 of the first type, or respectively three baffles 28, 30 and two silencer matts 29.

Expansion chamber 21, baffle chamber 23 and end plate 22 are held together by means of external tension members serving as connecting devices, namely rods 31. Each broadside is provided with two rods 31. These are held in place by in particular tube-like retainers 32, 33, 34 on the broadsides of end plate 22, baffle chamber 23 and expansion chamber 21 and are configured in the manner of bolts, with head 35, in particular with a hex socket, and thread 36. The retainers 32 of the expansion chamber 21 preferably have an internal thread for screwing in the rods 31. The rods 31 correspondingly extend along the entire length of the expansion chamber 21, baffle chamber 23 and end plate 22. The tube-like retainers 32, 33, 34 are firmly attached to the broadsides of expansion chamber 21, baffle chamber 23 and end plate 22.

To facilitate assembly and mutual centering, expansion chamber 21 and baffle chamber 23 have on their facing sides circumferential shoulders 37, 38, which engage with each other in a perfect fit. As can be seen in FIG. 2, the shoulder 37 is internal and the shoulder 38 is external. In analogous fashion, the end plate 22 and the baffle chamber 23 are provided with shoulders 39, 40 at their facing sides, wherein the shoulder 40 is provided externally at the end plate 22 and the shoulder 39 internally at the baffle chamber 23.

The connectors 24, 25 are realized in the manner of sleeves, having in this case an outer circumferential collar 41 at one end and an external thread 42 at the other end.

Figures 6A, 6B, 6C:
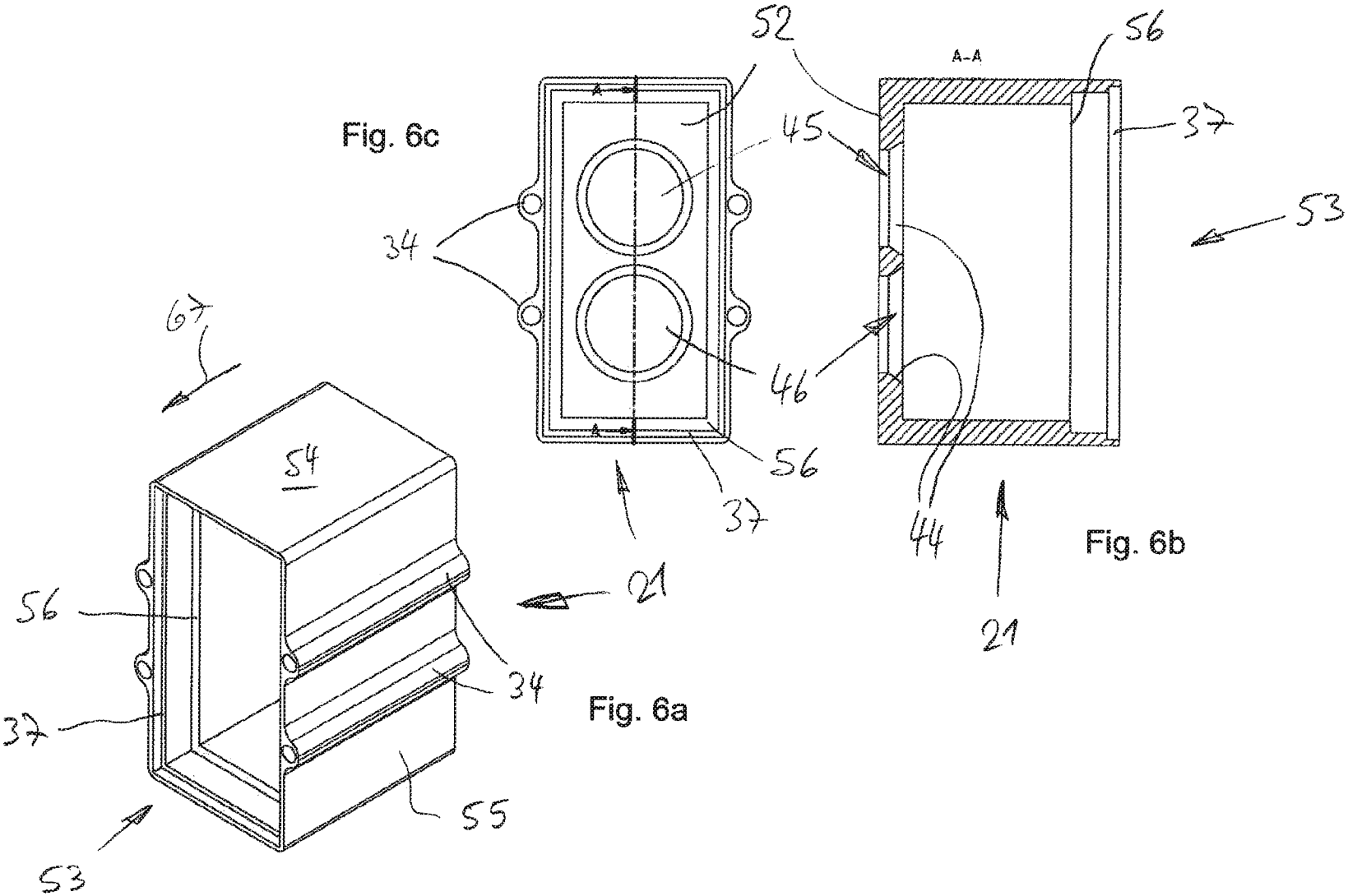
FIG. 6*a* shows a perspective view of an expansion chamber.
FIG. 6*b* shows a cross-sectional view through the expansion chamber in FIG. 6*a*.
FIG. 6*c* shows a view of the expansion chamber seen in the opposite direction of fire.

The collar 41 has an obliquely directed abutment surface 43 to the outer thread 42 42 and abuts against a corresponding abutment surface 44 of the expansion chamber 21, see FIG. 6*b*. For this purpose, the expansion chamber 21 has two apertures 45, 46 for the projectile which each have the abutment surfaces 44 toward the interior of the expansion chamber 21. The outer thread 42 of the connectors 24, 25 conforms to the inner thread of the barrels of an over-and-under shotgun (not shown). The inner thread is typically employed for the insertion of chokes. The spacing of the two apertures 45, 46 for the projectile conforms to the spacing of the two barrels of the over-and-under shotgun (not shown). The barrels of double-barreled shotguns may be spaced at different distances from each other. The sound suppressor provided here can be correspondingly adapted to a particular type of double-barreled shotgun.

In order to screw the connectors 24, 25 into shotgun barrels, mounting rings 47, 48 are provided which can slide along the connectors 24, 25 up to the collar 41 with a twist prevention feature. For this purpose, each of the connectors 24, 25 has two linear grooves 49 and each of the mounting rings 47, 48 has two inwardly directed cams 50 which lie in the linear grooves 49. In addition, the mounting rings 47, 48 are provided on their outer side with flat portions 51, which in particular are radially adjacent to the cams 50. Furthermore, two other flat portions are provided on the outer side, with the result that each mounting ring 47, 48 is provided on its outer circumference with a total of four flat portions 51 spaced at 90° apart from each other for the application of an appropriate tool, such as a wrench spanner or pliers.

In order to attach the sound suppressor 20, the connectors 24, 25 are first inserted into the expansion chamber 21 until the abutment surfaces 43, 44 lie against one another. The mounting rings 47, 48 are then slid onto the connectors 24, 25. Finally, the connectors are 24, 25 are inserted into the shotgun barrels and firmly screwed tight with the help of the mounting rings 47, 48.

The expansion chamber 21 has a cuboid-shaped configuration with front wall 52 for accommodating the apertures 45, 46 for the projectile, an open end side opposite thereto with the circumferential shoulder 37, narrow side walls 54 and large side walls 55. Arranged on the latter are the retainers 34 which are provided with an inner thread (not shown).

The expansion chamber 21 is preferably empty. When a shot is fired, the propellant gases can spread throughout the entire expansion chamber 21 and also into the unused barrel. Finally, the internal cross section of the expansion chamber 21 available for the expansion of the propellant gases is considerably larger than the cross section of a barrel or of all barrels.

In addition to the shoulder 37, the expansion chamber 21 has a shoulder 56, whose function will be described in more detail below in connection with a baffle and FIG. 7*a*.

The housing 26 of the baffle chamber 23 has a cuboid shape analogous to that of the expansion chamber 21, but is completely open at its two ends faces 57, 58. Narrow side walls 59 are joined to large side walls 60. The latter are provided on the outside with the aforementioned retainers 33. The ones here are configured without an internal thread.

As the end piece of the sound suppressor, the end plate 22 has two apertures 61, 62 for the projectile, but in its likewise cuboid-shaped configuration has only a very short dimension in the firing direction (in relation to the expansion chamber 21 and baffle chamber 23).

The bolt-like rods 31 are inserted into the retainers 32, 33, 34 contrary to the firing direction. The threads 36 are screwed into the inner threads of the retainers 34 (not shown) until the heads 35 abut against the retainers 32 and the end plate 22 contrary to the firing direction, thus firmly holding together the expansion chamber 21, baffle chamber 23 and end plate 22.

As already indicated above, the baffles 28, 30 and silencer mat 29 are arranged in succession within the sound suppressor 20. The first baffle 28 as seen in the firing direction is partially inserted into the expansion chamber 21 where it abuts the internal circumferential shoulder 56. In analogous fashion, the last baffle 28 as seen in the firing direction internally abuts a shoulder (not shown) of the end plate 22.

The two baffles 28, 30 differ somewhat in their construction. Both are cuboid in shape, having front walls 65 (first baffle 28) and 66 (second baffle 30) facing the expansion chamber 21 and provided with apertures 63, 64 for the projectile. The interior space of the baffles 28, 30 connecting to the front walls 65, 66 is empty and the opposite end faces 68, 69 are open. In this manner, each baffle 28, 30 forms a chamber.

Narrow side walls 70 of the first baffle 28 are provided with a large expansion opening 71. In addition, each of the narrow side walls 70 have on their exterior a depression running in the direction of fire with base 72 and lateral cheeks 73. The expansion openings 71 are provided in the bases 72. The cheeks 73 abut internally against the housing 26 and against the shoulder 56 of the expansion chamber 21 as closely as possible.

Each of the large side walls 74 of the first baffle 28 are configured with an expansion opening 75. The narrow side walls 70 together with the large side walls 74 define a surrounding wall, namely around the apertures 63, 64 for the projectile.

Figures 7A, 7B, 7C, 7D:
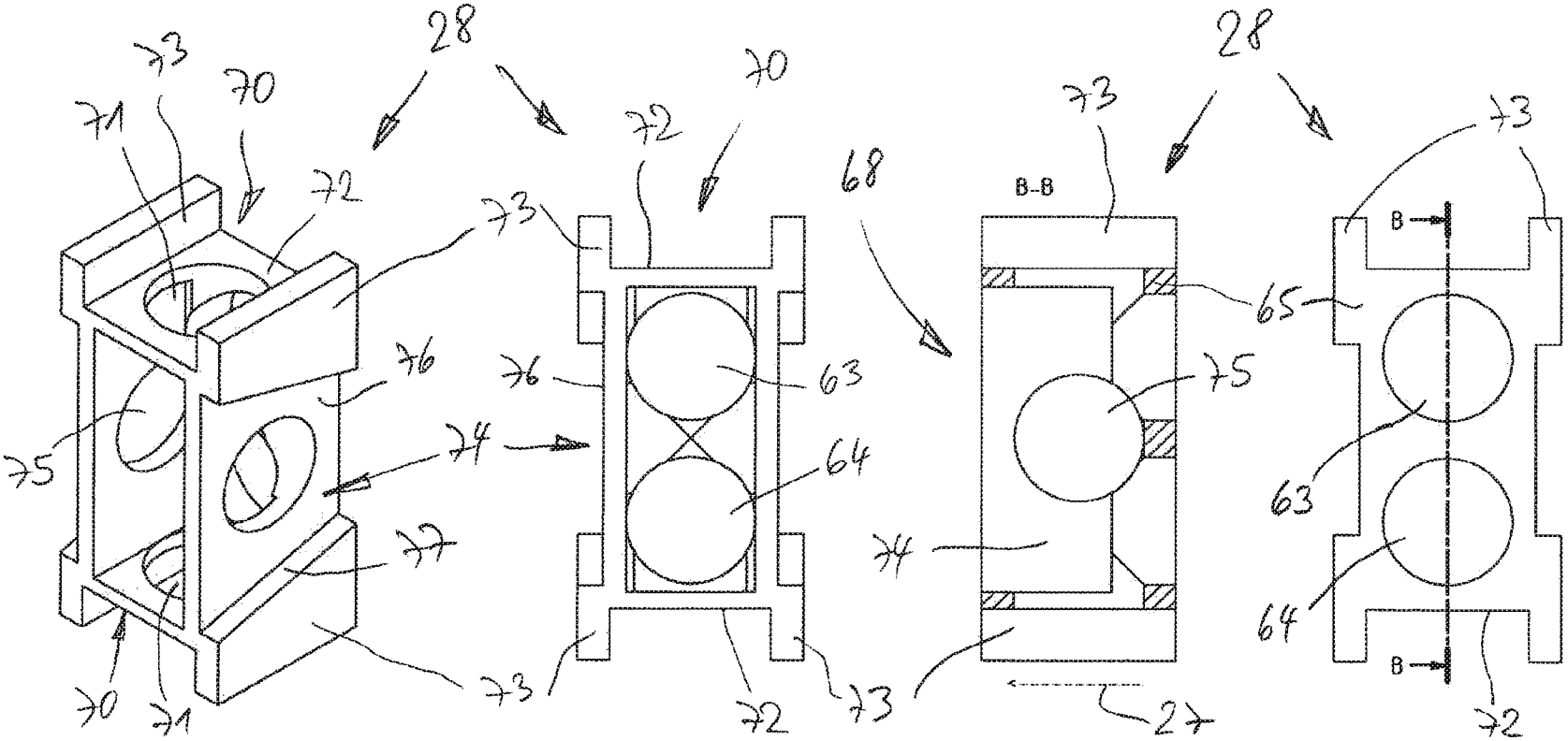
FIG. 7*a* shows a perspective view of a first baffle.
FIG. 7*b* shows a view of the baffle in FIG. 7*a* in the opposite direction of fire.
FIG. 7*c* shows a sectional view through the baffle in FIG. 7*a* along line B-B in FIG. 7*d*.
FIG. 7*d* shows a front view (in the direction of fire) of the baffle in FIG. 7*a*.

A depression is likewise formed on the outside of each side wall 74 and has here a conical configuration, that is to say with a cross section that increases in size in the direction of fire, see in particular FIG. 7*a*. The depression is delimited by a base 76 and the aforementioned lateral cheeks 73, which here assume a dual function, namely as cheeks assigned to the bases 72, on one hand, and on the other hand as cheeks assigned to the bases 76. The bases 72, 76, along with the lateral cheeks 73 and the respective opposite walls of the baffle chamber 23, form expansion channels (not shown in any further detail) running in the direction of fire.

Figures 8A, 8B, 8C, 8D:
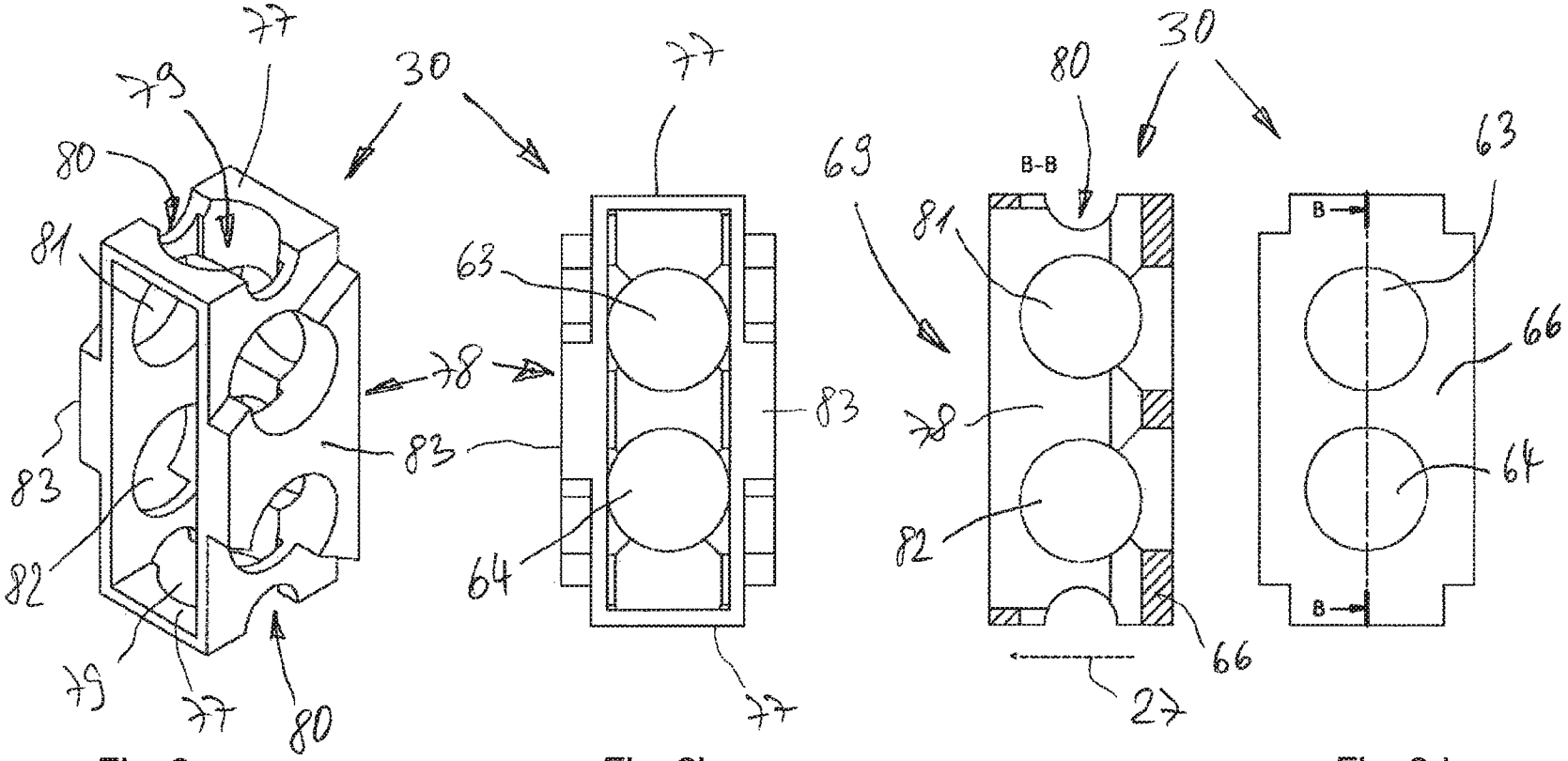
FIG. 8*a* shows a perspective view of a second baffle.
FIG. 8*b* shows a view of the baffle of FIG. 8*a* in the opposite direction of fire.
FIG. 8*c* shows a sectional view through the baffle in FIG. 8*a* along line B-B in FIG. 8*d*.
FIG. 8*d* shows a front view (in the direction of fire) of the baffle in FIG. 8*a*.
Figure 9B:
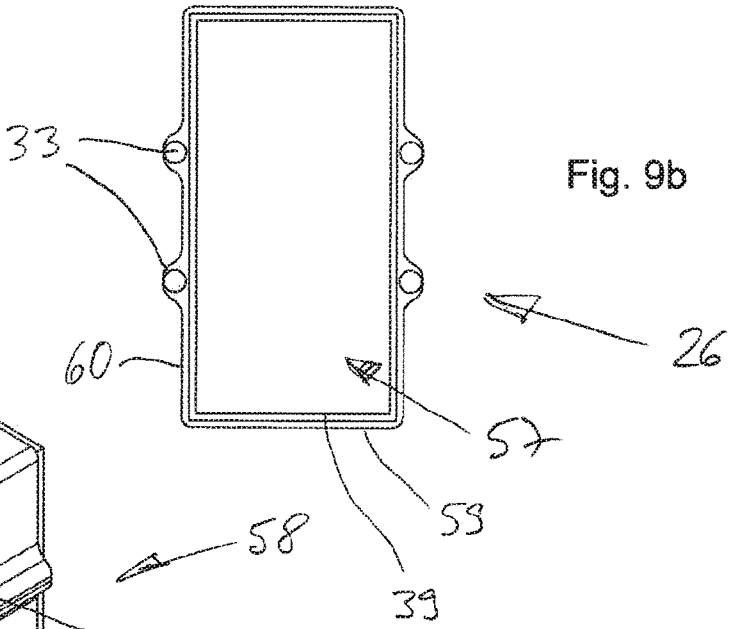
FIG. 9*b* shows a view of the baffle chamber in FIG. 9*a* in the opposite direction of fire.
Figure 9A:
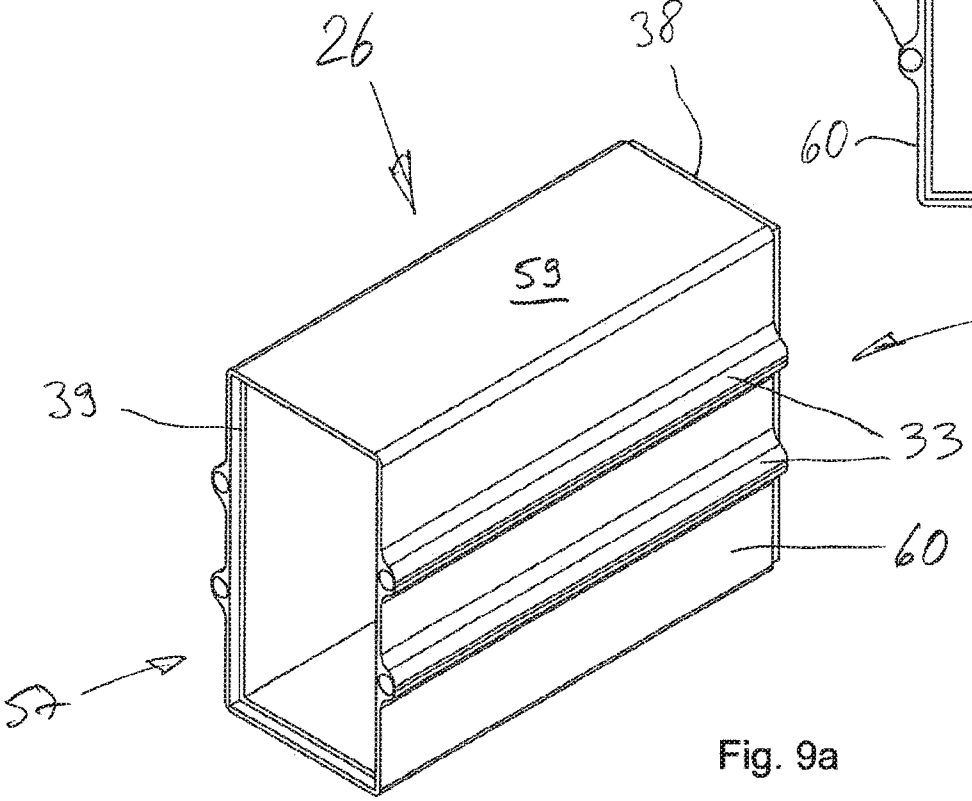
FIG. 9*a* shows a perspective view of a baffle chamber.
Figure 10D:
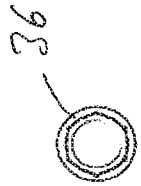
FIG. 10*d* shows a front view of the connecting rod in the direction of fire.
Figure 10C:
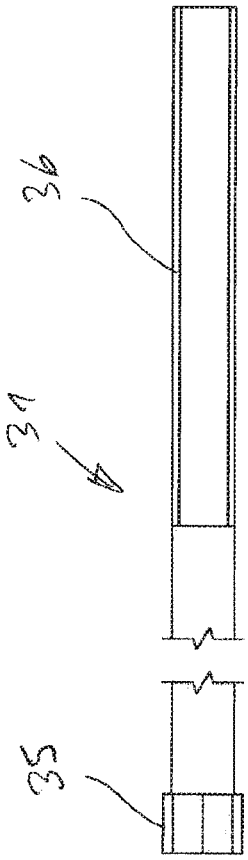
FIG. 10*c* shows a side view of the connecting rod.
Figure 10B:
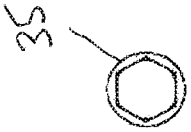
FIG. 10*b* shows a front view of the connecting rod in the opposite direction of fire.
Figure 10A:
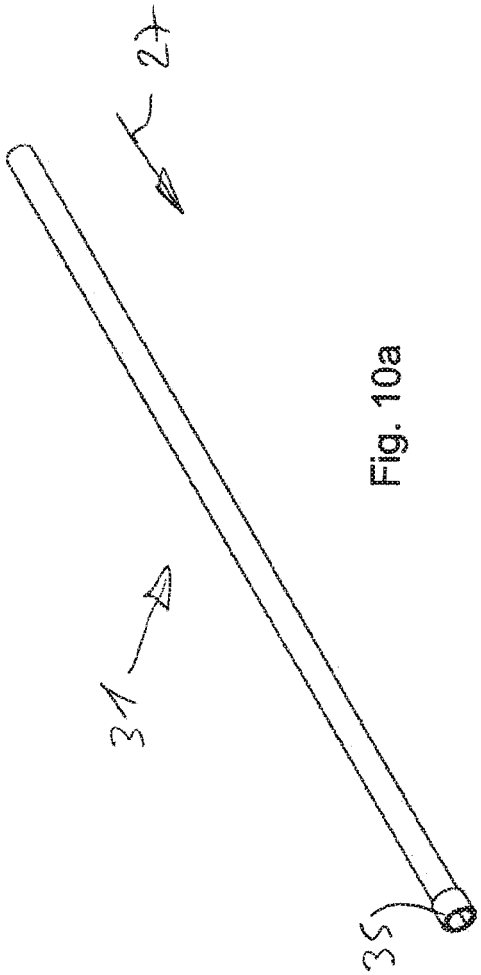
FIG. 10*a* shows a perspective view of a connecting rod.

The narrow side walls 77 and large side walls 78 of the second baffle 30 are configured somewhat differently. Each of the narrow side walls 77 is provided with a large expansion opening 79. In the region adjacent thereto, the large side walls 78 have crescent-shaped expansion openings 80 which merge across the corner with the expansion openings 79, see in particular FIG. 8*a*. But here too, the narrow side walls 70 along with the large side walls 74 form a circumferential wall around the apertures 63, 64 for the projectile.

The large side walls 78 are each provided with two large expansion openings 81, 82. Furthermore, each of the large side walls 78 are provided in an approximately central outer region with a thicker area 83. The cross section of the thicker area 83 becomes more narrow in the direction of fire as it extends along a semiperimeter of the expansion openings 81, 82, see in particular FIG. 8*a*. As a result, outside of the thicker area 83, i.e. near the narrow side walls 77 and in conjunction with the baffle chamber 23, expansion channels are formed whose cross section increases in size in the firing direction, see also FIG. 2. These expansion channels are connected to the interior space of the second baffle 30 via the crescent-shaped expansion openings 80 and the expansion openings 81, 82.

The shown sound suppressor 20 for double-barreled shotguns is provided to correspond to the number of parallel apertures 45, 46 and 61 to 64 for the projectile. Two projectile pathways 84, 85 run through the sound suppressor 20 in continuation of the connectors 24, 25, see FIG. 1, and therefore also through each baffle 28, 30. As an alternative, the sound suppressor can be configured to have only one projectile pathway for a single-barreled firearm. In that case, the components 21, 28, 29, 30, 29, 28, 22 following one another in the direction of fire in FIG. 3 are approximately just half as high as shown, as is the baffle chamber 23. In addition, only one of the connectors 24, 25 is provided.

Figure 11A:
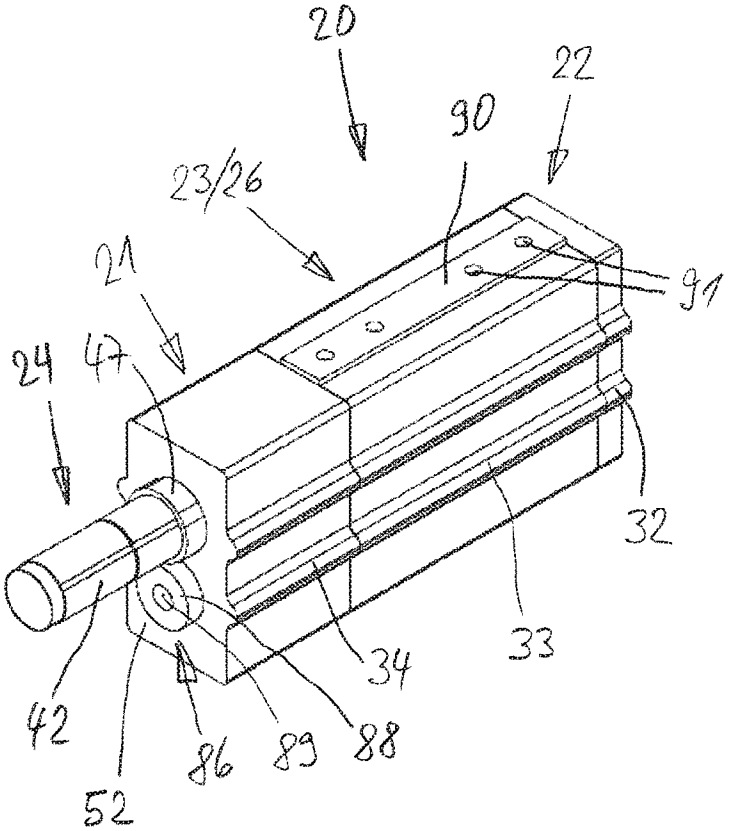
FIG. 11*a* shows a perspective view of a further embodiment of the sound suppressor.
Figure 11B:
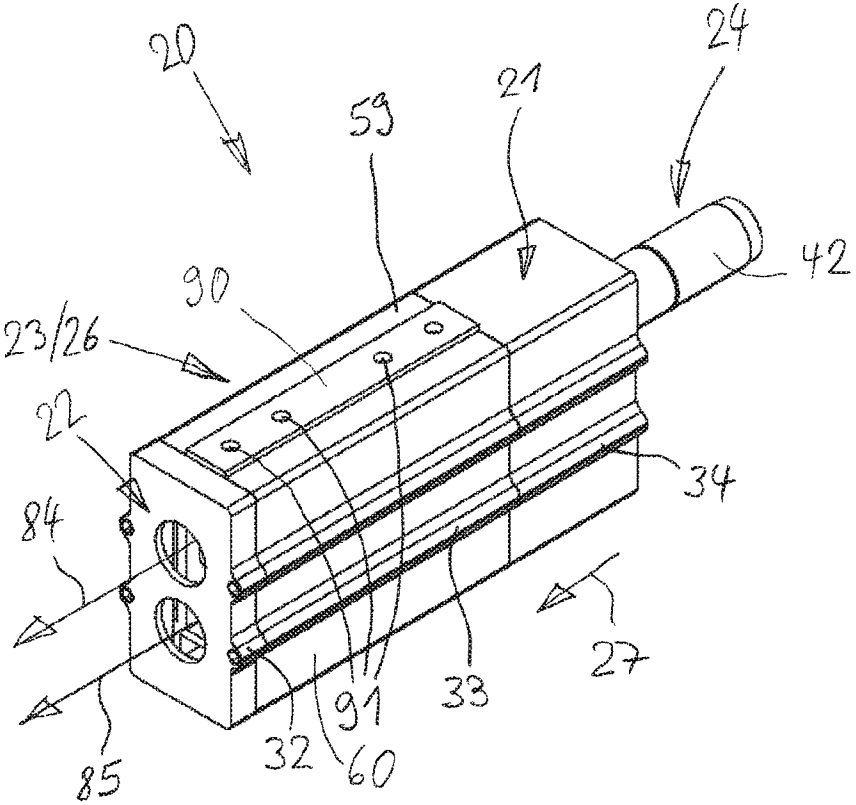
FIG. 11*b* shows a different perspective view of the sound suppressor of FIG. 11*a*.

FIGS. 11*a*, 11*b* show the sound suppressor 20 with only one connector 24 in the front wall 52 of the front piece 21. As in the previous exemplary embodiment, the front wall 52 here has two apertures 45, 46 for the projectile. The connector 24 is seated in the upper aperture 45 for the projectile. An insert 86 is provided in the lower aperture 46 for the projectile which seals said aperture 46. The sound suppressor pursuant to FIGS. 11*a*, 11*b* can thereby be employed for a single-barreled firearm.

Figure 12A:
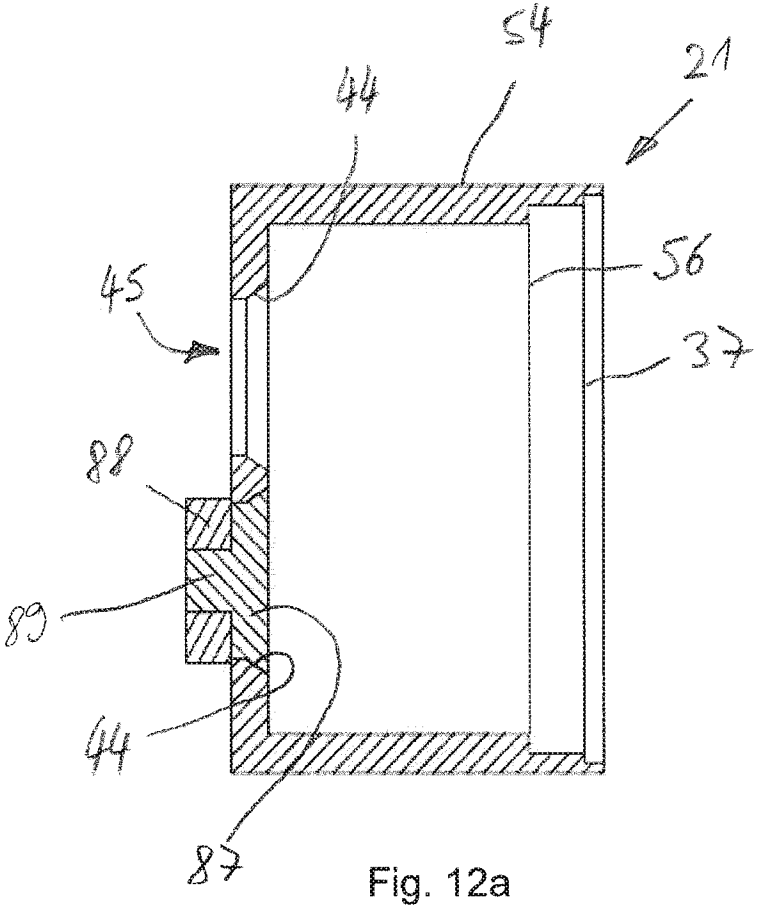
FIG. 12*a* shows a sectional view through a front piece of the sound suppressor of FIG. 11*a*, with an insert for closing an aperture for the projectile.
Figure 12B:
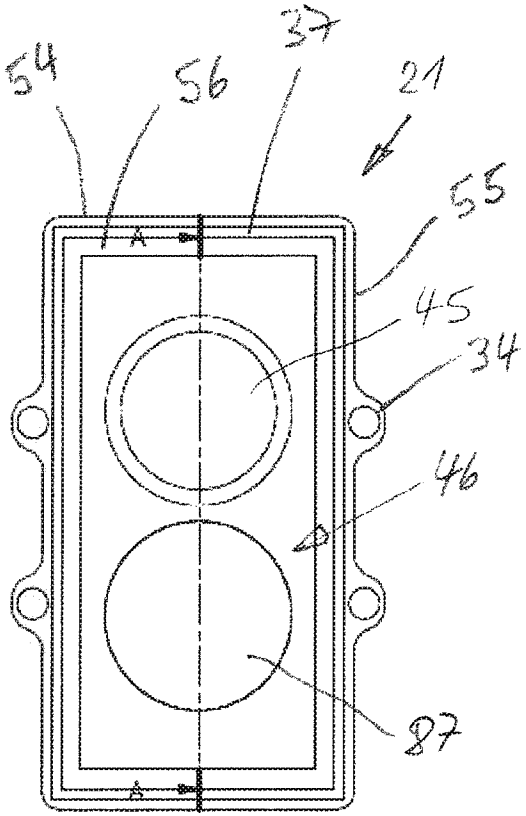
FIG. 12*b* shows a top view (interior view) of the front piece of FIG. 12*a*), specifying the sectional plane A-A to FIG. 12*a*.
Figure 13B:
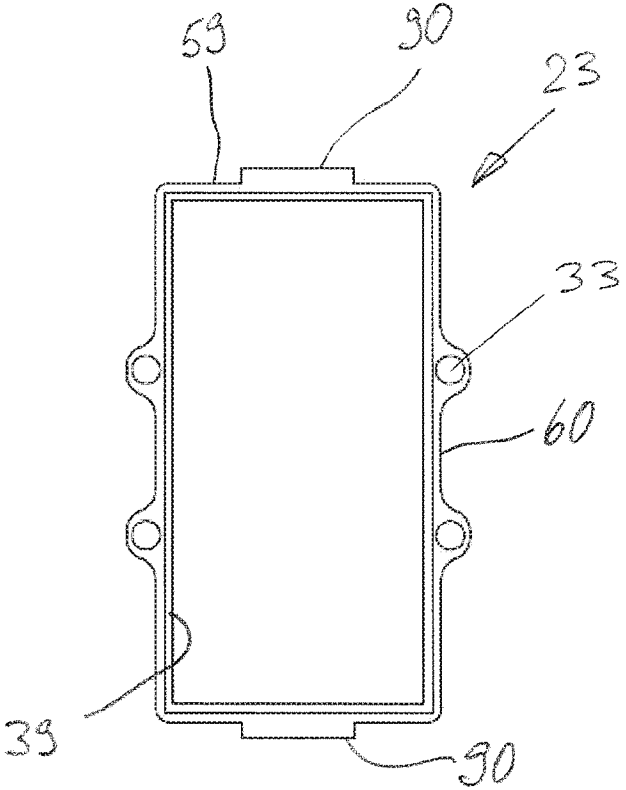
FIG. 13*b* shows a front view of the baffle chamber (viewed in the direction of fire)
Figure 13A:
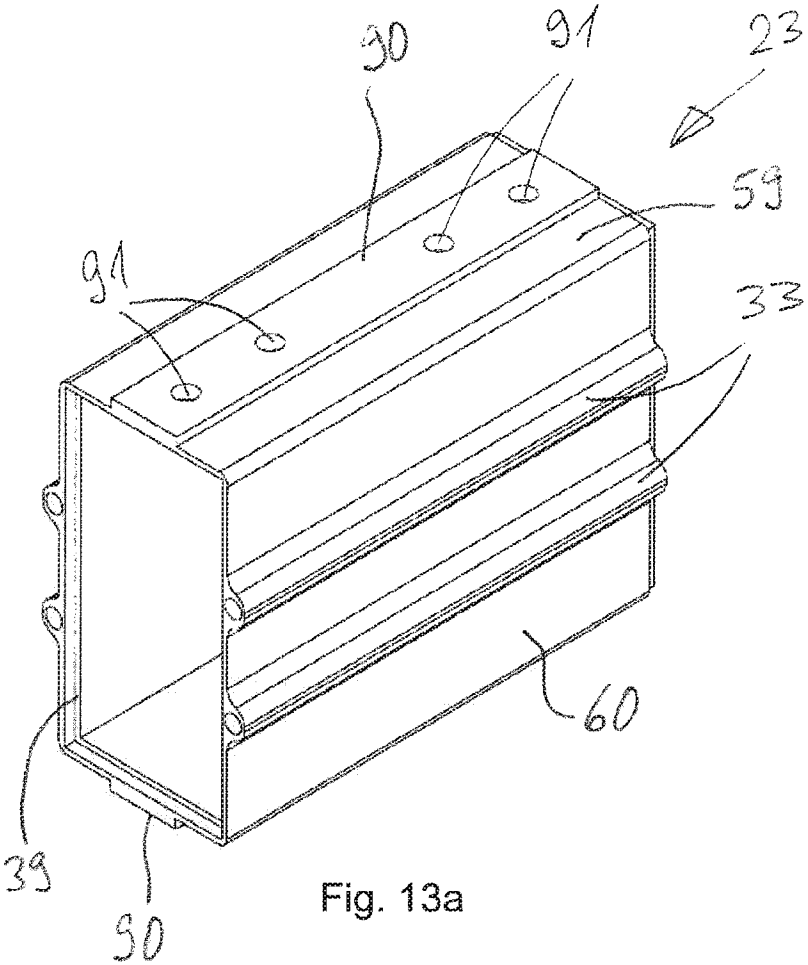
FIG. 13*a* shows a perspective view of the baffle chamber from the sound suppressor of FIG. 11*a*, with one adaptor each for a Picatinny rail on the top side and bottom side (on the narrow side walls)

Here the insert 86 comprises two parts, see also FIG. 12*a*, with a solid body 87 for abutment on the abutment surface 44 and a screw nut 88 for screwing onto an outwardly projecting extension 89 of the body 87. Extension 89 and screw nut 88 have matching threads. The screw nut 88 is dimensioned for firmly clamping the insert 86 in such a manner that its outer diameter is somewhat larger than the inner diameter of the aperture 46 for the projectile.

FIGS. 11*a*, 11*b*, 13*a*, 13*b* show a further special feature of this exemplary embodiment. The sound suppressor 20 is provided with a strip-like adapter 90 running in the firing direction (arrow 27). The adapter 90 forms an elevated area on the narrow side wall 59 of the baffle chamber 23, in this example on the two narrow side walls 59, in other words on the top and bottom side in FIGS. 11*a*, 11*b*, 13*a*, 13*b*.

The adapter 90 can be integrated in the side wall 59, for example, or it can be a metal profile that has been welded or bonded to it. Threaded holes 91 are recessed in the adapter 90. As a whole, the adapter 90 is designed such that a so-called Picatinny rail can be attached to it. The Picatinny rail is standardized and is employed to accommodate attachments, for example an optical sight. Older shotguns in particular are not equipped to accommodate a Picatinny rail. The sound suppressor with the adapter 90 makes it possible to use attachments having a Picatinny rail.

As an alternative, the adapter 90 can be configured and provided for being connected with other types of rails for accommodating attachments.

Figure 14:
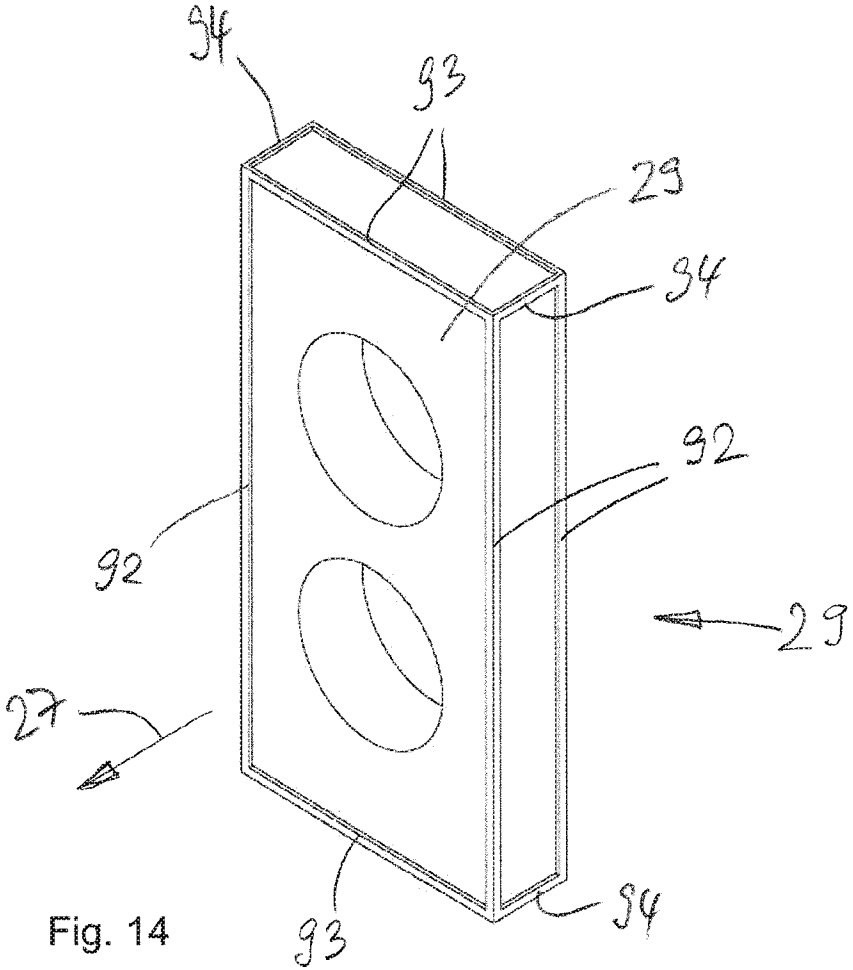
FIG. 14 shows a silencer mat with frame for insertion into the sound suppressor.

A further special feature is illustrated in FIG. 14. It shows the silencer mat 29 with a frame of steel wire or some other sufficiently rigid material. Here the frame has long transversal braces 92, short transversal braces 93 and short longitudinal braces 94. The terms "transversal brace/longitudinal brace" are designated in relation to the firing direction as indicated by arrow 27.

The frame provides the silencer mat 29 with a permanent outer contour so that the silencer mat 29 always occupies the same volume. This can be important if the silencer mat 29 is provided as a precisely-fitting spacer between two baffles 28, 30.

LIST OF DESIGNATIONS

20 sound suppressor
21 expansion chamber (front piece)
22 end plate
23 baffle chamber
24 connector
25 connector
26 housing
27 arrow (direction of fire)
28 first baffle
29 silencer mat
30 second baffle
31 rods
32 retainers (on end plate)
33 retainers (on baffle chamber)
34 retainers (on expansion chamber)
35 head
36 thread
37 shoulder (interior)
38 shoulder (exterior)
39 shoulder (interior)
40 shoulder (exterior)
41 collar
42 external thread
43 abutment surface
44 abutment surface
45 aperture for projectile
46 aperture for projectile
47 mounting ring
48 mounting ring
49 linear grooves
50 cams
51 flat portions
52 front wall
53 end face
54 narrow side walls
55 large side walls
56 shoulder
57 end face
58 end face
59 narrow side walls
60 large side walls
61 aperture for projectile
62 aperture for projectile

63 aperture for projectile
64 aperture for projectile
65 front wall
66 front wall
67
68 open end face
69 open end face
70 narrow side walls
71 expansion opening
72 bases
73 cheeks
74 large side walls
75 expansion opening
76 base
77 narrow side walls
78 large side walls
79 expansion opening
80 crescent-shaped expansion openings
81 expansion openings
82 expansion openings
83 thicker area
84 projectile pathway
85 projectile pathway
86 insert
87 body
88 screw nut
89 extension
90 adapter
91 threaded holes
92 long transversal brace
93 short transversal brace
94 short longitudinal brace

What is claimed is:

1. A sound suppressor for a firearm having at least one barrel, the sound suppressor comprising:

a common expansion chamber (21) having a wall (52) at a first end of the common expansion chamber (22), one side of the wall (52) facing the at least one barrel, and an end plate (22) attached at a second end of the common expansion chamber (21);

at least two apertures (45, 46), through the one side of the wall (52) facing the at least one barrel, for a projectile to pass through into the common expansion chamber (21);

at least two projectile pathways (84, 85), each of which extends through a respective one of the at least two apertures (45, 46) through the wall (52), through the common expansion chamber (21), and through the end plate (22);

at least one choke-type connector (24, 25) for the insertion into the at least one barrel of the firearm, the at least one choke-type connector (24, 25) being received and retained in a respective one of the at least two apertures (45, 46), and a respective one of the at least two projectile pathways (84, 85) also extending through the at least one choke-type connector (24, 25); and an insert (86) for closing one of the at least two apertures (45, 46).

2. The sound suppressor as claimed in claim 1, wherein each of the at least one choke-type connector (24, 25) has an enlargement (41) of an effective outer diameter at an end pointing in a firing direction of the projectile, with each enlargement (41) abutting against a side of the wall (52) facing away from the at least one barrel.

3. The sound suppressor as claimed in claim 2, wherein each enlargement (41) is a circumferential collar.

4. The sound suppressor as claimed in claim 3, wherein each enlargement (41) and the wall (52) have mutually corresponding and circumferential abutment surfaces (43, 44), with each of the mutually corresponding and circumferential abutment surfaces (43, 44) being inclined in a radial direction.

5. The sound suppressor as claimed in claim 1, wherein each connector (24, 25) has a thread (42) for attachment to the at least one barrel and wherein each connector (24, 25) is provided with an outer sleeve serving as a mounting ring (47, 48) that is axially displaceable but held on each connector (24, 25) in an anti-twist manner.

6. The sound suppressor as claimed in claim 5, wherein each connector (24, 25) is provided externally with at least one axially directed depression and wherein each outer sleeve has at least one protrusion on an inside thereof, wherein each protrusion conforms to a position and shape of each depression such that each outer sleeve is secured against twisting on each connector (24, 25).

7. The sound suppressor as claimed in claim 5, wherein each outer sleeve has flat portions (51) on an outer side for the application of a tool.

8. The sound suppressor as claimed in claim 1, wherein the common expansion chamber (21) has a cuboid-shaped configuration.

9. The sound suppressor as claimed in claim 1, wherein the common expansion chamber (21) is connectable to the at least one barrel.

10. The sound suppressor as claimed in claim 1, further comprising at least one baffle chamber (23) having separate chambers disposed in succession in a firing direction of the projectile, between which separate chambers gasses can pass along apertures for the projectile and along other openings between the separate chambers.

11. The sound suppressor as claimed in claim 10, wherein each of the at least two projectile pathways (84, 85) runs through the successive chambers in a firing direction of the projectile without the provision of separate sub-chambers for each of the at least two projectile pathways (84, 85).

12. The sound suppressor as claimed in claim 10, wherein the wall (52), the common expansion chamber (21), the at least one baffle chamber (23), and the end plate (22) are arranged in succession in a firing direction of the projectile, wherein at least two of the successive elements are successive to each other and are connected to each other by rods (31).

13. The sound suppressor as claimed in claim 12, wherein the rods (31) are disposed on or in outer walls (55, 60) of the successive elements.

14. The sound suppressor as claimed in claim 12, wherein one of the successive elements is the expansion chamber (21) and another one of the successive elements is the end plate (22), and the rods (31) connect the expansion chamber (21) to the end plate (22).

15. The sound suppressor as claimed in claim 12, wherein one of the successive elements is the at least one baffle chamber (23) comprising at least one baffle (28, 30), wherein each baffle (28, 30) is configured with a circumferential wall running around at least one aperture (63, 64) for the projectile, and wherein the circumferential wall has openings (75, 81, 82) arranged transversely to the firing direction and the circumferential wall is provided on an outer side with reinforcements (73, 83), which in conjunction with chamber walls (59, 60) of the at least one baffle chamber (23) form gas channels running parallel to the firing direction.

16. The sound suppressor as claimed in claim 15, wherein, on account of the corresponding configuration of the reinforcements (73, 83), the gas channels have cross sections which decrease or increase in size in the firing direction.

17. The sound suppressor as claimed in claim 15, further comprising at least two different baffles (28, 30) arranged in the at least one baffle chamber (23), with a baffle of a first type alternating with a baffle of a second type in the firing direction.

18. The sound suppressor as claimed in claim 1, further comprising at least one baffle chamber (23) between the common expansion chamber (21) and the end piece (22), the at least one baffle chamber having at least two baffles (28, 30) provided in succession in a firing direction of the projectile.

19. The sound suppressor as claimed in claim 1, further comprising a multi-part construction as seen in a firing direction of the projectile, the multi-part construction comprising the expansion chamber (21) for connecting to the at least one barrel, a baffle chamber (23) having at least one baffle (28, 30), the end plate (22), and connecting devices which extend from the end plate (22) to the expansion chamber (21).

20. The sound suppressor as claimed in claim 19, wherein the common expansion chamber (21) and the baffle chamber (23) have complementary circumferential shoulders (37, 38) such that no relative movement transverse to the firing direction is possible.

21. The sound suppressor as claimed in claim 19, wherein the baffle chamber (23) and the end piece (22) have complementary circumferential shoulders (39, 40) such that no relative movement transverse to the firing direction is possible.

22. The sound suppressor as claimed in claim 1, further comprising at least one adapter (90) for the attachment of accessory parts, the at least one adapter being located on an outer side of the sound suppressor.

23. The sound suppressor as claimed in claim 22, wherein the adapter (90) is formed by at least one raised portion on the outer side of the sound suppressor, and in that the raised portion has at least one borehole (91) for the connection of accessory parts to the adapter (90).

24. The sound suppressor as claimed in claim 1, further comprising at least one baffle chamber (23) between the common expansion chamber (21) and the end piece (22), the at least one baffle chamber (23) having at least one baffle (28, 30) and at least one silencer mat (29).

25. The sound suppressor as claimed in claim 24, wherein the silencer mat (29) is provided with a three-dimensional frame that extends transverse to a firing direction of the projectile and in the firing direction.

* * * * *